US012209349B2

(12) United States Patent
Schaumann et al.

(10) Patent No.: US 12,209,349 B2
(45) Date of Patent: Jan. 28, 2025

(54) WASHING MACHINE AND METHOD FOR OPERATING SUCH A WASHING MACHINE

(71) Applicant: E.G.O. Elektro-Geraetebau GmbH, Oberderdingen (DE)

(72) Inventors: Uwe Schaumann, Oberderdingen (DE); Antonio Di Maggio, Schwaigern (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 506 days.

(21) Appl. No.: 17/453,500

(22) Filed: Nov. 4, 2021

(65) Prior Publication Data

US 2022/0145517 A1 May 12, 2022

(30) Foreign Application Priority Data

Nov. 6, 2020 (DE) ..... 10 2020 213 968.7

(51) Int. Cl.
*D06F 33/46* (2020.01)
*D06F 33/34* (2020.01)
(Continued)

(52) U.S. Cl.
CPC ..... *D06F 39/083* (2013.01); *D06F 33/34* (2020.02); *D06F 39/04* (2013.01); *D06F 39/085* (2013.01);
(Continued)

(58) Field of Classification Search
CPC ..... D06F 33/46; D06F 33/72; D06F 34/24; D06F 39/04; D06F 39/08; D06F 39/083;
(Continued)

(56) References Cited

U.S. PATENT DOCUMENTS

2004/0237212 A1* 12/2004 Shaffer ..... D06F 33/46 68/12.02
2015/0330013 A1* 11/2015 Miller ..... G05B 19/0428 68/17 R
2020/0337518 A1 10/2020 Tobias et al.

FOREIGN PATENT DOCUMENTS

DE 4313539 A1 10/1994
DE 19908804 A1 * 9/2000 ..... D06F 35/006
(Continued)

OTHER PUBLICATIONS

Machine Translation of WO-2022057109-A1, Fu et al., Mar. 2022. (Year: 2022).*

(Continued)

*Primary Examiner* — David G Cormier
(74) *Attorney, Agent, or Firm* — ALSTON & BIRD LLP

(57) ABSTRACT

A washing machine has a rotatable drum in a drum-receiving container with an outlet, a pump with integrated heating device, an injector on the drum-receiving container, a water circuit with several water pipes, wherein at least one water pipe runs from the outlet from the drum-receiving container to the pump, and at least one water pipe runs from the pump to the injector, and a water reservoir between the outlet and pump which is connected to the water pipe from the outlet to the pump. An outlet valve is provided in the water pipe from the outlet from the drum-receiving container to the pump. A pump valve is also provided which is connected to a water pipe with a pump outlet and has an output to a water outlet from the washing machine.

12 Claims, 3 Drawing Sheets

(51) Int. Cl.

| | |
|---|---|
| ***D06F 39/04*** | (2006.01) |
| ***D06F 39/08*** | (2006.01) |
| *D06F 39/20* | (2024.01) |
| *D06F 103/16* | (2020.01) |
| *D06F 105/06* | (2020.01) |
| *D06F 105/10* | (2020.01) |

(52) U.S. Cl.
CPC ..... *D06F 39/088* (2013.01); *D06F 39/20* (2024.01); *D06F 2103/16* (2020.02); *D06F 2105/06* (2020.02); *D06F 2105/10* (2020.02)

(58) Field of Classification Search
CPC ..... D06F 39/085; D06F 2103/16; D06F 2105/06; D06F 2105/10
See application file for complete search history.

(56) References Cited

FOREIGN PATENT DOCUMENTS

| | | | | |
|---|---|---|---|---|
| DE | 102011003467 | A1 | 8/2012 | |
| DE | 102014214353 | A1 | 1/2016 | |
| DE | 102014114106 | A1 * | 3/2016 | ..... D06F 39/04 |
| DE | 102016200602 | A1 | 7/2017 | |
| DE | 102018122474 | A1 | 3/2020 | |
| DE | 102019205919 | A1 | 10/2020 | |
| EP | 2559803 | A1 | 2/2013 | |
| EP | 2764814 | A1 | 8/2014 | |
| WO | WO 2019/081013 | A1 | 5/2019 | |
| WO | WO-2022057109 | A1 * | 3/2022 | |

OTHER PUBLICATIONS

Machine Translation of Finke et al., DE-102014114106-A1, Mar. 2016. (Year: 2016).*

Machine Translation of Bolduan et al., DE-19908804-A1, Sep. 2000. (Year: 2000).*

European Patent Office, Extended European Search Report received for Application No. 21202493.9, dated Mar. 18, 2022, 10 pages, Germany.

* cited by examiner

WASHING MACHINE AND METHOD FOR OPERATING SUCH A WASHING MACHINE

CROSS-REFERENCE TO RELATED APPLICATIONS

This application claims priority to German Application No. 10 2020 213 968.7, filed Nov. 6, 2020, the contents of which are hereby incorporated herein in its entirety by reference.

AREA OF APPLICATION AND PRIOR ART

The invention concerns a washing machine and a method for operating such a washing machine.

EP 2559803 A1 discloses a washing machine which has a so-called top-flooding system. Water is applied to the laundry in a drum from above in order to soften the laundry and apply washing agent dissolved in the water so that it can act. In contrast to conventional washing machines, this machine does not merely control a water level at the bottom of the drum or a drum-receiving container surrounding the drum, known as the sump. For this, namely a large amount of water is required, and this quantity should be reduced by such a top-flooding system.

US 2020/0337518 A1 describes a washing machine with a special water circuit containing a water reservoir. Water from the washing process, which need not necessarily be completely clean, can in effect be temporarily stored in this water reservoir for later use in the washing process.

TASK AND SOLUTION

The invention is based on the object of creating a washing machine cited initially and a method for its operation with which the problems of the prior art can be solved, and in particular it is possible to configure a washing machine advantageously and operate it advantageously.

This object is achieved by washing machine with the features of claim 1 and by a method for its operation with the features of claim 11. Advantageous and preferred embodiments of the invention are the subject of the further claims and are explained in more detail below. Some of the features are described only for the washing machine or only for the method for its operation. Irrespective thereof, they may apply however to both such a washing machine and to a method, autonomously and independently of one another. The wording of the claims is included in the content of the description by explicit reference.

The washing machine has a rotatable drum for receiving laundry. Advantageously, the rotatable drum has a horizontal rotational axis and on the casing side may comprise several or a plurality of holes, small or large, as known in particular from the above-mentioned prior art. A drum-receiving container is arranged around the drum and comprises an outlet. At this outlet or together with this outlet, a sump may be formed which can however be operated with a considerably lower water level than is normal for washing. Advantageously, with the washing method according to the invention, there is no water level at the bottom of the drum and/or the drum-receiving container, and the water collecting there runs to the outlet from the drum-receiving container. The washing machine has a pump for pumping liquid, in particular water used for washing. The pump has an integrated heating device and may advantageously be configured according to DE 102011003467 A1.

An injector is provided on the drum-receiving container for introducing or spraying water into the drum, onto the laundry contained therein. The injector is arranged higher in the vertical direction than the pump, advantageously it is arranged relatively high at the top of the drum-receiving container, while the pump may be arranged lower or below the drum-receiving container. The injection of water into the drum-receiving container and into the drum need not take place under particularly high pressure. The cleaning effect is not created or improved by the impact of the water on the laundry at high speed; the water need merely reach the laundry in the drum. For this, advantageously in the known fashion, the at least one injector may be provided in the drum wall and overlap with one of the holes in the drum for the injection of water, as described above. This is easily possible using simple sensors. In addition or alternatively, at least one injector may be provided in the door opening on the door seal for the drum, or in its vicinity or on its periphery, in order to inject water from the front through the usual front drum opening, but advantageously always onto the laundry therein from above.

The washing machine has a water circuit with several water pipes. At least one water pipe runs from the outlet from the drum-receiving container to the pump. At least one further water pipe runs from the pump to the injector. Thus it is possible to circulate the water, so that it is applied repeatedly by means of the pump onto the laundry from above in order to dampen this or apply washing agent thereto. For this, also there is no need for the sump with standing water at the bottom of the drum, for which a greater quantity of water is simply essential.

A water reservoir known in principle from the prior art is provided or connected between the outlet and the pump and is connected to the water pipe from the outlet from the drum-receiving container to the pump, or is arranged in this water pipe. The water reservoir may thus be a type of passage for water from the outlet; alternatively, it may be connected to a branching water pipe which can be closed by means of a valve in order to fill or empty the water reservoir as required.

According to the invention, it is provided that an outlet valve is provided in the water pipe from the outlet from the drum-receiving container to the pump. This outlet valve may advantageously be provided in a water path between the outlet and the water reservoir, irrespective of the design or connection of the water reservoir to the water circuit. Advantageously, thus water can be drained to the outlet from the drum or drum-receiving container and/or be introduced into the water reservoir as required. Alternatively, water may also be introduced into the water reservoir either on the direct route via an above-mentioned water pipe or via further water pipes and valves.

Furthermore, according to the invention a pump valve is provided which is connected to a water pipe at the pump outlet from the pump, in particular the only pump outlet of the pump. This pump valve has an output which leads to a water outlet from the washing machine, in particular to a drainage water connection for the washing machine. Thus the pump can completely remove used water from the washing machine. Thus it is for example possible that the entire washing machine only has one single pump, and no further pump, in particular no lye pump which is otherwise required for pumping out water from the washing machine to a water drain.

In particular, thus with a washing machine according to the invention, it is possible not only to apply again to the laundry, via the injector nozzle, water which had previously drained out from the laundry downwards. Also, water can be applied to the laundry from the water reservoir, and also water may have been previously introduced into the water reservoir. Further advantageous possibilities for the method according to the invention will be explained later in detail; firstly, the possible structure of the washing machine will be described.

In a further embodiment of the invention, it may be provided that the water reservoir is arranged closer to the pump than to the outlet from the drum-receiving container. Thus a short path between the water reservoir and pump can be achieved which measures for example 5 cm to 30 cm, advantageously 8 cm to 20 cm. This is advantageous in particular for rapid and direct pumping of water out of the water reservoir by means of the pump.

In a further refinement of the invention, the water reservoir may have pressure-balancing means, in particular an overpressure valve in an upper region. As an alternative to an overpressure valve, here a simple opening may be provided, or a pressure-balancing container which is fluid-conductively connected to the water reservoir and has a flexible wall. Thus pumping of the water in and out is simplified since the water reservoir may have only a single water pipe as a connection. Because of air in the water reservoir, neither a greatly reduced pressure nor a greatly increased pressure should occur, so that above all the air can escape or flow in through an overpressure valve or opening as required.

Advantageously, the pump valve may be arranged in the water pipe from the pump to the injector, wherein it has an output to the injector. It may be arranged higher than half the height in the vertical direction between the pump and the injector, preferably therefore closer to the injector than to the pump, viewed in the vertical direction. Particularly advantageously, a distance from the pump valve to the injector may amount to 5 cm to 30 cm, preferably 10 cm to 20 cm. Thus the water pipe between the pump and the pump valve has a greater length, advantageously 20 cm to 100 cm, particularly advantageously 30 cm to 70 cm. This will be explained in more detail below for a highly advantageous function of the washing method.

In a preferred embodiment of the invention, the pump valve is a three-way valve with one input and two outputs. One output of the three-way valve runs to the water outlet from the washing machine, as explained initially. The input runs to the pump, or a water pipe from the pump leads to the input. A further output of the pump valve, as explained above, leads to the injector.

For the injector, it is advantageously provided that this is arranged relatively high at the top of the drum-receiving container or drum. It should be arranged at the height of at least the upper third of the drum, particularly advantageously at least the upper tenth of the drum. A preferred arrangement of the injector is at a height above the drum, in particular at the highest point of the drum-receiving container. From this point, the injector also has the best spray angle for water onto laundry which is situated at different points or distributed differently in the drum. A single injector may be provided for the entire washing machine, i.e. with only a single opening. Alternatively, several injectors may be provided, for example distributed horizontally from a rear region of the drum over a middle region to a front region of the drum. An injector need then not be movable in any direction, but merely movable along one axis or able to spray water onto laundry in the drum in distributed fashion.

It is possible, by means of several valves, in particular downstream of the pump valve, to conduct the water in targeted fashion to one or several of the plurality of injectors. This may be advantageous if a precise localization of laundry in the drum is possible and has been carried out.

In one embodiment of the invention, the water reservoir may have a volume which is greater than the volume of the water pipes and the pump, between the water reservoir and a valve arranged in the water pipe between the pump and the injector, in particular the pump valve. Thus at least the entire quantity of water contained between the water reservoir and the pump valve can be introduced into or arranged in the water reservoir. Advantageously, the volume may be 50% to 200% greater. Under some circumstances, the water reservoir may have a volume from 0.5 l to 3 l, in particular from 0.8 l to 1.5 l. Thus it is possible that the pump introduces onto the laundry, at the top through the injector, a specific quantity of water, in particular all the water in the water pipe between the pump and pump valve or injector. For this, the pump must be able to draw in more water which may also come from the water reservoir. This is advantageous above all in the application of water, heated by means of the heating device, onto the laundry. It cannot be simply assumed that, at the same time, as much water runs to the pump as to the outlet from the drum-receiving container, so that the pump can pump water in an effectively continuous circuit.

In a further embodiment of the invention, a water outlet from the washing machine leaves from the water reservoir directly without the interposition of the pump, or generally a pump. Such a water outlet may also be conducted to a drain i.e. out of the washing machine. For this, a water pipe with a valve device may be provided on the water reservoir. Thus for example a complete evacuation of the water reservoir as possible, for example even if this is arranged at a lower point in the washing machine than the pump itself. Thus for example a pump may be drained into the water reservoir, advantageously simply by the water running out. This residual water can then be drained from the water reservoir and from the entire washing machine via the water outlet. This also allows the omission of an additional lye pump.

In the method for operating a washing machine as described above, as a first step a specific water volume in the water circuit is pumped by the pump from the water reservoir into the water pipe between the pump and the injector, namely up to a predefined limit water volume. During this process, the water is heated by means of the heating device of the pump. Although such a heating device may be powerful, in practice it is not sufficient to heat up freshly introduced water, with a temperature of usually 12° C. to 18° C., to a desired washing temperature of for example 40° C. to 60° C. So the water volume previously pumped is drained or pumped back by the pump into the water reservoir, depending on pump design. This return of water from the water pipe back to the water reservoir may be supported by a pumping operation, but this is not essential. For this, a pump with reversible running direction or reversible pumping direction would be necessary. This need not however be provided because the water pipe connected to the pump outlet is arranged at a higher level. If the pump stops operation, it can be assumed that water simply flows back from the water pipe downward in the reverse direction through the pump, so that it can again be introduced into the water reservoir. It is possible that, during this return flow i.e. when the pump has stopped its pumping operation, the water is heated further by operation of the heating device. Advantageously, here the heating device is operated at lower power than during the pumping operation, but this may be optimized by temperature control. The steps of pumping and heating and return are repeated for a specific time period or a specific number of times, in particular until a desired predefined temperature for the water is reached. The water is thus effectively shuttled back and forth from the water reservoir via the pump into the water pipe, preferably with as much input of heating power as possible in order to be heated as quickly as possible to the desired predefined temperature. This in practice may entail five repeats, up to twenty or even thirty repeats, mainly depending on the level of the desired predefined temperature. Then the adequately heated water can be pumped through the water pipe to the injector and thus introduced into the drum, in particular onto the laundry situated therein. When the water is heated for the first time with repeated shuttling and is then applied to the laundry with the desired predefined temperature, after a short time it drains out of the laundry again at the bottom and from the outlet from the drum-receiving container. In doing so, the water has usually cooled, although not quite as greatly as to the original temperature. This water may then be collected again in the water reservoir for a while; alternatively, additional fresh water may also be introduced. This water can then be heated to the desired predefined temperature again with the steps cited initially, by repeated pumping to and from or shuttling. It may then either be applied onto the laundry in precisely the same position as before, or alternatively the drum can be rotated slightly with partial revolutions or full revolutions in order to distribute the laundry therein, so that now further laundry can be wetted.

It is conceivable that with this method, using a top-flooding system for the washing machine, the requirement for fresh water is substantially lower because the machine works without a large quantity of standing water in the sump of the washing machine. The time required may be slightly extended, but this may be at least partially compensated by a corresponding heating power of the heating device of the pump and its pumping power.

During the multiple performance of the pumping step, in particular also during introduction of the heated water into the drum and onto the laundry, advantageously the water supply may be stopped, in particular if sufficient water is present in the washing machine. Thus in effect, a closed quantity of water can be pumped to and from or shuttled or moved between the water pipe and water reservoir, and during this process heated. This can be monitored precisely by permanently measuring the temperature of this water, for example via a temperature sensor on the pump which can measure the true water temperature thanks to a sufficient distance from the heating device of the pump. Alternatively, a temperature may be detected at the water circuit downstream of the pump and upstream of the injector. This has the advantage that then the true temperature of the water can be detected as closely as possible to the injector, and hence as closely as possible to the laundry. A temperature detection is here advantageously provided before the pump valve, since this preferably forms the maximum water level during the shuttling of the water to and fro. In the same way as described above for the water reservoir, an overpressure opening or similar should also be provided at this pump valve, so that preferably air can escape and be drawn in, but as far as possible no water.

A controller for the pump, advantageously the corresponding washing machine controller, may store information on for how long or with what power the pump must pump water, so that it is pumped from the water reservoir sufficiently far into the water pipe but not yet quite reaching the pump valve. Then no sensors or similar are required which detect when the water here reaches the pump valve.

In a further embodiment of the invention, during the repetition of the steps of pumping and heating and return of the water into the water reservoir, the drum may remain unmoved, in particular until after injection of the heated water through the injector into the drum and onto the laundry situated therein. Preferably, it is also possible that the drum is moved or rotated in the previously described fashion after injection of the heated water.

In an advantageous embodiment of the invention, the heated water is pumped from the water reservoir as completely as possible by the pump, in particular during injection of adequately heated water into the drum. Thus as much of the heated water as possible may be introduced, wherein its quantity should naturally be matched to the washing process, i.e. to the water volume required for the quantity of laundry contained. It may also be provided that further water or fresh water is introduced into the water reservoir, alternatively water already flowing out to the outlet, and pumping continues until the above-mentioned temperature detection shows that the temperature has fallen below a limit temperature. This may avoid the introduction of water, with a temperature below said limit temperature, into the drum despite the use of as much heated water as possible. This limit temperature may for example lie 1° C. to 5° C. below the above-mentioned predefined temperature. The observation of temperature specifications should be ensured in particular for a washing process in which the water for mixing with the washing agent should have a precise temperature in order for the washing agent to be as effective as possible.

In yet a further embodiment of the above-described method, it may be provided that the pumping operation is stopped and the water remaining in the water circuit downstream of the pump is returned to the water reservoir. During this process, it may be heated again and repeatedly pumped by the pump into the water circuit and returned while being heated again, until it regains the predefined temperature and can then be again introduced into the drum via the injector. Depending on the quantity of water already introduced, the drum may be moved or not moved in-between.

In a possible embodiment of the invention, the water reservoir may have a filter, in particular a coarse filter for large particles of several millimeters diameter in the used water. By returning or pumping the water back to the water reservoir, the water may also be used to backflush the filter. Then together with the above-described embodiment of the invention, it is possible to drain or pump this back-flushed water and filtrate, i.e. undesirable coarse particles, into a drain from the washing machine.

The outlet valve of the type cited initially may advantageously be configured such that it can be opened sufficiently wide to allow air with positive pressure to pass through or escape, in particular to allow air to escape during pumping of the water to and fro. However, no water is allowed through, since otherwise this could again partially eliminate the advantage of the defined or closed quantity of water which is gradually heated.

In a further embodiment of the invention, it is possible that washing agent and/or other additives for washing laundry are introduced into the water reservoir, alternatively into the water pipe before or after the pump. For this, a dosing device known in itself may be used. It is possible here that the washing agent or additives are not only introduced manually by an operator for a single washing process, as known, but for this a respective storage container is provided in the washing machine. The dosing device may then in effect provide a corresponding dose automatically under control by the washing machine controller, so that no operator is required for this.

Furthermore, it is advantageous if water with washing agent or other additives dissolved or contained therein is pumped repeatedly by the pump into the water pipe up to the pump valve and returned or pumped back into the water reservoir. This serves for even better dissolution or mixing of the washing agent and/or additives with the water. This may avoid the problem with a liquid washing agent that the washing agent does not dissolve sufficiently in the water, for example because when mixed directly into the water in a sump in the washing machine in a conventional process, the dissolution is not always sufficiently good. This means that either washing agent must be over-dosed or the washing effect is too low. Pumping the water with introduced washing agent or additive to and fro two to five times is regarded as sufficient for optimum mixing, but this may also be repeated more times. A further heating of the water may also take place, so that it is ensured that the washing agent or additive is brought to its known optimal temperature. This is advantageous for example if relatively temperature-sensitive enzymes are used for the washing process. Their predefined temperature should be observed as precisely as possible for optimal effect.

In a further possible embodiment of the invention, a flow sensor may be provided on the water pipe, for example on the water pipe shortly behind the pump. Thus the actual quantity of water flowing or pumped through can be measured precisely, so that this need not be calculated from the pumping power or pumping duration.

These and further features arise not only from the claims but also from the description and the drawings, wherein the individual features may be implemented each alone or in groups in the form of sub-combinations in an embodiment of the invention and in other fields and constitute advantageous and protectable embodiments for which protection is hereby claimed. The division of the application into individual sections and subheadings does not restrict the general validity of the statements made therein.

BRIEF DESCRIPTION OF THE DRAWINGS

Exemplary embodiments of the invention are depicted schematically in the drawings and explained in more detail below. The drawings show.

DETAILED DESCRIPTION OF EXEMPLARY EMBODIMENTS

Figure 1:
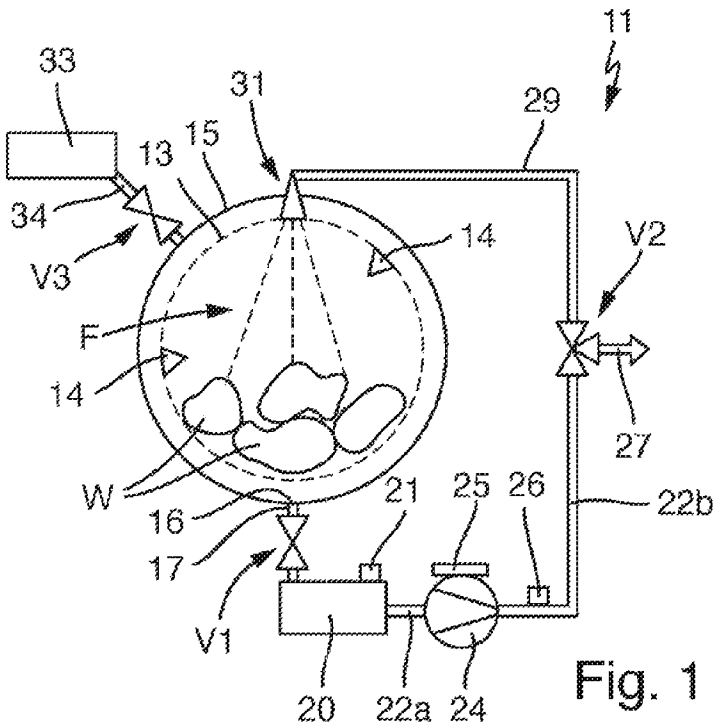
FIG. 1 a simplified schematic illustration of a washing machine according to the invention with water circuit with a drum-receiving container, via a valve, a water reservoir, a pump, and a further valve, to an injector at the top of the drum-receiving container, FIG. 2 the illustration from FIG. 1 showing different volumes in the water circuit and a path for shuttling a specific water volume, FIG. 3 a derivative of the illustration from FIG. 1 with a valve and a water pipe towards the outside, FIG. 4 a further derivative of the washing machine from FIG. 3 with a further reservoir for water upstream of the actual water reservoir, and FIG. 5 an illustration of the overall structure of a washing machine according to the invention, and to illustrate steps of the method according to the invention for operating such a washing machine.

FIG. 1 shows a washing machine 11 according to the invention with a rotatable drum 13 in which laundry W is present, here shown as a single laundry item W. Carriers 14 may be arranged on the inside of the drum. The drum 13 is rotatably mounted in a drum-receiving container 15, here with a horizontal rotational axis. At the bottom, a sump pipe 17 as a water pipe leads from an outlet 16 from the drum-receiving container 15 via a valve V1 to a water reservoir 20. A further pump pipe 22*a* leads from this water reservoir 20 to a pump 24. This pump 24 is configured as explained in relation to the prior art outlined initially, for example according to DE 102011003467 A1, advantageously as an impeller pump. It has an integrated heating device 25 which is here illustrated highly diagrammatically. The heating device 25 serves to heat water conveyed by the pump, in particular in the pump chamber, for which advantageously it is itself arranged in the pump chamber or on a wall of the pump chamber.

From the pump 24, a further pump pipe 22*b* leads to a three-way valve as a pump valve V2. In the one valve position, water can travel from the pump 24 or the pump pipe 22*b* to a water outlet 27, which leads out of the washing machine 11 and for example runs into a drainage connection in a utility room, advantageously by means of a conventional flexible hose. Via the water outlet 27, water can be extracted or discharged from the washing machine 11.

In another position, water passes from the pump pipe 22*b* via a supply pipe 29 to an injector 31. The injector 31 is arranged at the highest point of the drum-receiving container 15 and is configured such that it does not protrude directly into the rotatable drum 13, but in the known fashion can deliver or spray or inject water F through the openings made therein onto the laundry W arranged in said drum. Reference is made for this to the prior art which shows this sufficiently well.

At the top left on the drum-receiving container 15, a washing agent container 33 is arranged from which washing agent or other additives for a washing process can be introduced via a water pipe 34 and a dosing valve V3 into the drum-receiving container 15 or onto the laundry W in the drum 13, alternatively also by means of a nozzle (not shown). In a further alternative which will be explained below with reference to FIG. 4, washing agent may either be introduced into the lowest region of the drum-receiving container 15 shortly in front of the outlet 16, or into the sump pipe 17, so that it is first mixed with or dissolved in the water before being applied to the laundry W.

Figure 2:
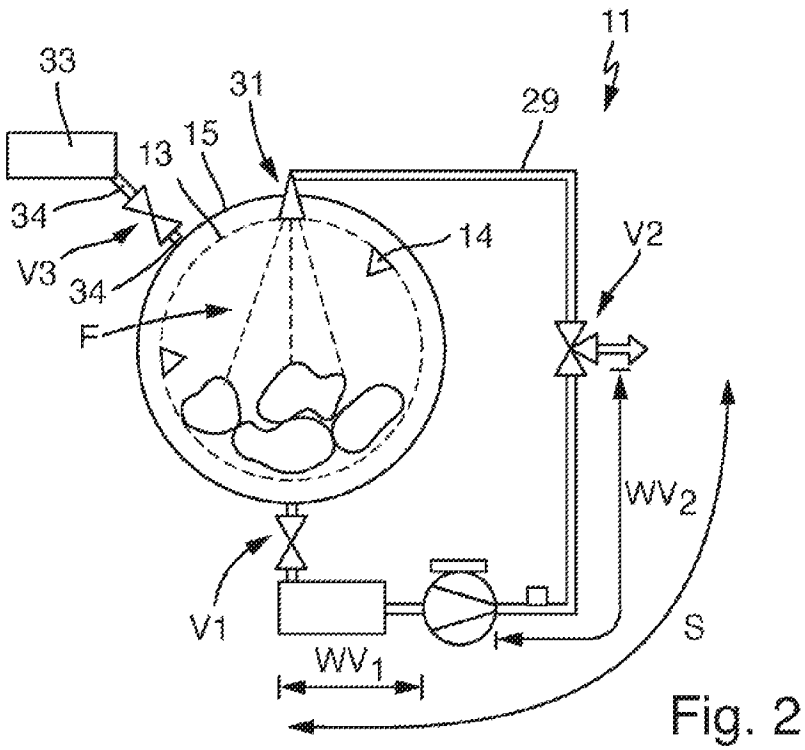

FIG. 2 shows the same washing machine 11 again, but the sake of the clarity with significantly fewer reference signs. Reference is made to FIG. 1. With respect to the water circuit, it is shown that this is divided roughly into a portion in front of the pump 24 and a portion behind the pump 24. Upstream of the pump 24, a water volume $WV_1$ is formed which comprises the water reservoir 20 and an overpressure valve 21 provided thereon as a pressure-balancing means, and the pump pipe 22*a*. On the right, downstream of the pump 24 or between the pump 24 and the pump valve V2, located at a higher level, is the second water volume $WV_2$. The water volumes $WV_1$ and $WV_2$ are thus substantially formed by the water reservoir 20 and the pump pipe 22*a* on one side, and the pump pipe 22*b* on the other. Small volume regions in the pump 24 may be added thereto, such as for example a suction connector and/or a pressure connector. In an advantageous embodiment of the invention, the water volume $WV_1$ includes the region up to the pump chamber, and the water volume $WV_2$ includes the region behind or after the pump chamber up to the pump valve V2. The water volume $WV_1$ may for example comprise 2 l, and the water volume $WV_2$ 0.75 l.

In the washing method according to the invention as described above, after closing the outlet valve V1 and the pump valve V2, the pump 24 can pump water from the largely or completely filled water volume $WV_1$, in particular when the water reservoir 20 is full, into the water volume $WV_2$ which is empty at that time. During this pumping process, the water is heated by means of the heating device 25. If 0.75 l are pumped out of the water reservoir by the pump 24, the water volume $WV_2$ is effectively filled. The water column in the pump line 22*b* thus reaches to the pump valve V2 or shortly before this. Pressure-balancing means or similar (not shown here) on the pump valve V2 allow air to escape but not water. When the pump 24 can no longer pump water against the pump valve V2 which is closed to this (a situation which can be detected by various sensors or alternatively from the operating state of the drive motor of the pump 24), operation of the pump 24 is stopped. Then the pump 24 has pumped and heated approximately 0.75 l, which is considered as the limit water volume cited initially. The pump 24 can then either go into reverse operation and pump the water from the water volume $WV_2$ back to the water reservoir 20 or into the water volume $WV_1$. Alternatively, the water can simply flow back through the pump 24 under gravity, in particular into the pump pipe 22*b* located higher. Then new operation of the heating device 25 may take place, advantageously with temperature control in order to achieve neither too high a water temperature nor too high a temperature at the heating device 25 itself. The water, or above all the limit water volume corresponding to the water volume $WV_2$, is thus now again positioned upstream of the pump 24 and in the larger water volume $WV_1$. Advantageously, a degree of mixing takes place and hence heating of the entire water volume $WV_1$, although naturally with overall a lower temperature than the water volume $WV_2$ which has been heated once or twice. Then the pump 24 again pumps a limit water volume out of the water volume $WV_1$ into the water volume $WV_2$, wherein again heating takes place by operation of the heating device 25. When the water volume $WV_2$ is full or has been filled, the entire water amount is then returned. This to and fro movement due to operation of the pump 24 and return of the water defines the above-mentioned shuttling movement or shuttling S of a specific water volume, namely the limit water volume. This quite generally advantageously takes place without interruption after a partial movement, so that no time is wasted, and heating takes place as quickly as possible. Temperature sensors on the pump 24, in particular on the heating device 25, or alternatively a temperature sensor 26 on the pump pipe 22*b* shortly behind the pump 24, can determine the temperature of the conducted water, in particular in order to check whether the water now has the desired temperature for application to the laundry W. If this is the case, the pump valve V2 is opened and the pump 24 again works in pumping mode, advantageously again together with the heating device 25. This time, water is pumped up to the injector 31 and through this onto the laundry W; advantageously, the water volume is determined by a washing machine controller (not shown here) for the washing process. Advantageously, this is not the entire water volume $WV_1$, since this presumably would be too large, or too much water would have to be applied since the laundry W is at rest, and hence the water would effectively always be applied at the same points. A predefined water volume of for example 0.5 l to 1 l may be applied, in particular approximately 0.75 l corresponding to the water volume $WV_2$. This water all has the desired temperature as it comes from the water reservoir 20 or from the heated water volume $WV_1$.

Furthermore, the water volume $WV_1$ which has been brought to the desired temperature should be so great that it corresponds approximately to the volume of $WV_2$ plus the volume of the supply pipe 29, plus the desired water volume to be applied. Then the pump 24 does not draw in any air from the water volume $WV_1$ before the end of application of the desired water volume. In fact no further pumping would be possible, in particular air drawn in would have to be removed in complex fashion.

The water volume $WV_2$ need not necessarily correspond to the volume of the pump pipe 22*b* between the pump 24 and the pump valve V2; advantageously however, it corresponds to this to some extent or approximately. As much water can be moved or shuttled to and fro as possible in order to increase its temperature. Furthermore, the water volume $WV_1$ should be significantly greater than the water volume $WV_2$ plus the volume of the supply pipe 29, in order to be able to apply a correspondingly desired quantity of heated water F onto the laundry W.

After stopping pump operation, advantageously the pump valve V2 remains open, the outlet valve V1 may also be opened. Thus water runs firstly from the outlet 16 via the sump pipe 17 into the water reservoir 20 or into the water volume $WV_1$ in order to be heated again as explained above. Furthermore, water runs from the supply pipe 29 and the pump pipe 22*b* through the pump 24 back into the water volume $WV_1$. In a further possibility, further fresh water may be added, in particular via a fresh water supply pipe to the washing agent container 33 and the dosing valve V3, so that the water volume $WV_1$ is again relatively full despite the water consumed or absorbed by the laundry W. Then operation of the pump and heating of the water as a shuttling S according to FIG. 2 resumes until the water has again been heated or warmed sufficiently. Then it is again applied by means of the injector 31 to the laundry W which has been moved slightly by a slight or multiple movement or rotation of the drum 13, so that the water can reach different regions of the laundry W.

Depending on the heating power of the heating device 25, a five-fold to ten-fold repetition of the shuttling S may be sufficient to heat the water to 30° C. to 40° C. For higher temperatures, the water must be pumped or shuttled correspondingly more often to and fro in order to be able to introduce even more heating energy.

If now washing agent is applied to the laundry W from the washing agent container 33 for the washing process following the first rinsing process, then in the above-mentioned fashion this washing agent may be introduced from the washing agent container 33 through the dosing valve V3 into the drum-receiving container 15, so that there it extends only from below up to the outlet 16 and into the sump pipe 17. Alternatively and advantageously, the dosing valve V3 however leads directly to the outlet 16 or into the sump pipe 17, for which naturally the washing agent container 33 and dosing valve V3 are arranged as close as possible thereto. The washing agent container 33 may be configured for manual addition in individual doses per washing process; alternatively, it may be a storage container with a larger quantity of washing agent and additives, from which a washing machine controller automatically adds the required or calculated quantity. Also, it could be introduced directly into the water reservoir 20 or pump pipe 22*a*.

Since usually the washing agent should be applied to the laundry W in heated water, wherein the temperature depends on the washing agent, now the water complete with washing agent, or water in which the washing agent or additives have been dissolved or are at least contained, is moved again to and fro by the pump 24. This serves for heating of the water with washing agent or additive, i.e. the washing liquor. Furthermore, this serves for mixing or dissolving the washing agent or additive as well as possible in the water, which should take place completely with a multiple pumping process.

Similarly to the process described above, after reaching the desired temperature for the washing liquor, this can be again applied to the laundry W by the pump 24 via the supply pipe 29 and the injector 31. This advantageously again takes place repeatedly, in particular in each case with the laundry W moved slightly by partial rotation of the drum 13. Fresh washing liquor can be produced either with fresh water and added washing agent or additive, advantageously part thereof again comes from the outlet 16 from the bottom of the drum-receiving container 15 and is then topped up with washing agent or additive and water so the water volume $WV_1$ is again full.

Figure 3:
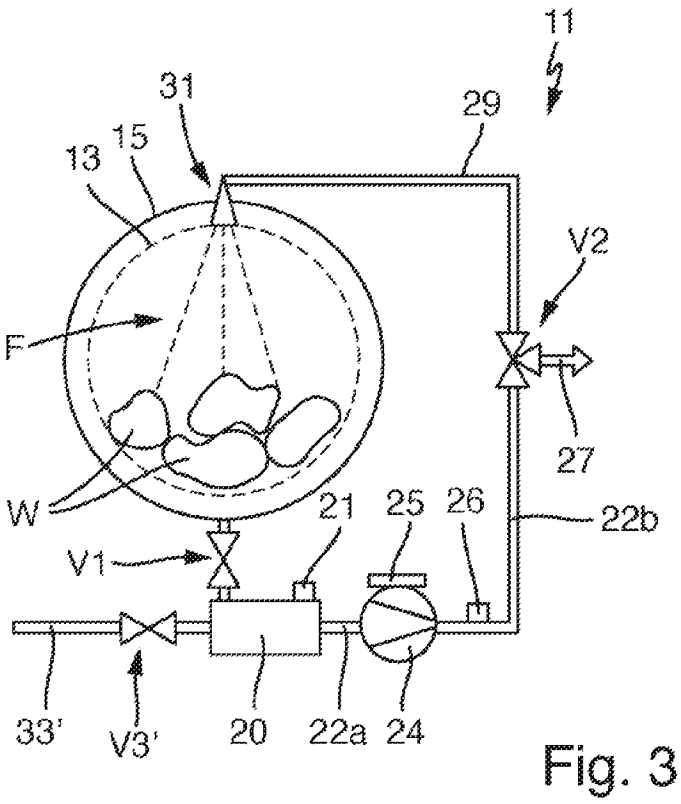

FIG. 3 shows a washing machine 11 with an alternative embodiment of the washing agent container. Here a washing agent pipe 33' is provided which leads directly into the water reservoir 20 via a dosing valve V3'. This corresponds to the process described above. The washing agent pipe 33' could also replaced by a said washing agent container or washing agent store for automatic dosing.

Alternatively, in FIG. 3, the pipe 33' could be a further or main water outlet from the washing machine 11. The valve V3' would then be an outlet valve, so water could drain out of the washing machine 11 at a relatively low region directly into the waste water, in some cases without the support of the pump 24.

Figure 4:
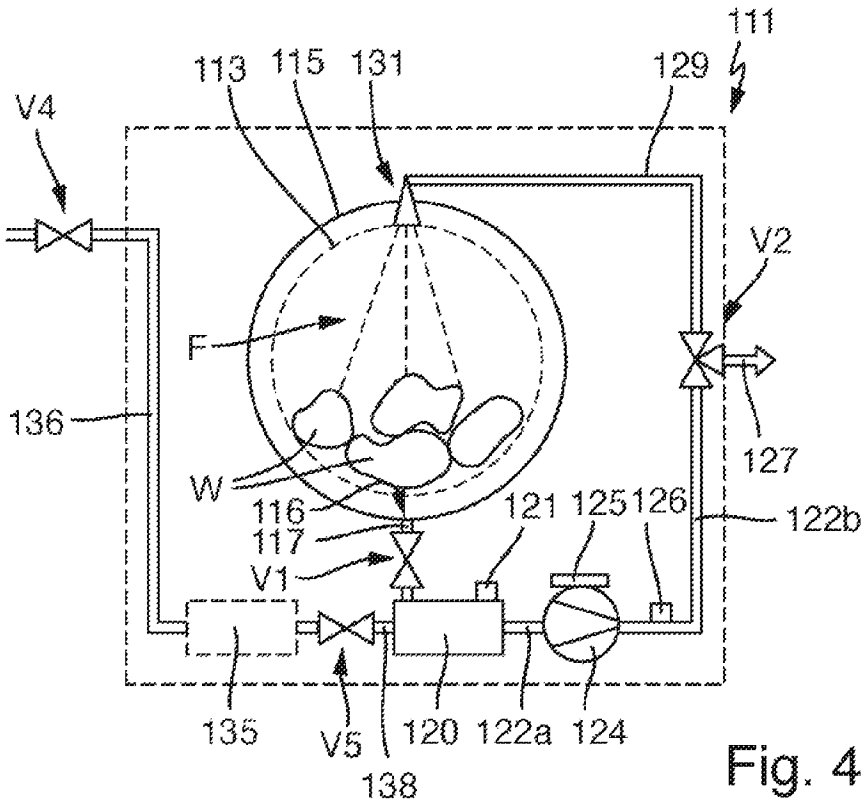

FIG. 4 shows a washing machine 111 with a drum 113 in a drum-receiving container 115, at the bottom of which an outlet 116 and sump pipe 117 and outlet valve V1 are provided. From valve V1, a short water pipe leads to a water reservoir 120 and overpressure valve 121. To the right of the water reservoir 120, a pump pipe 122*a* leads to a pump 124 which is configured as described with reference to FIGS. 1 to 3. After the pump 124, a further pump pipe 122*b* leads to a three-way valve V2 as the pump valve. From this, a water outlet 127 leads to the right and a supply pipe 129 leads upward to the injector 131. In this respect, the washing machine 111 of FIG. 4 corresponds to that of FIG. 1. In addition, here a further container is provided as an additional reservoir 135 for water, which is fed from an additional pipe 136 coming from the left. At the top left end, an additional valve V4 is provided. A connecting valve V5 is provided in a connecting pipe 138 to the water reservoir 120, in order to be able to control a water flow between the additional reservoir 135 and the water reservoir 120.

The container or additional reservoir 135 is an option which can perform further functions for the washing machine or for a washing process. This may for example be an above-mentioned addition of washing agent or additives; alternatively, filters may be provided therein for water which is supplied into the circuit as fresh water via the additional valve V4 and the additional pipe 136. Also, to the left of the additional valve V4, a water outlet could be provided to a drainage water connection of the washing machine 111. A filter could be provided in the additional reservoir 135, which filters the water again before it is pumped out of the washing machine 111 and conducted into a waste water pipe. Here for example, filters for microfiber particles could also be provided, for which reference is made to WO 2019/081013 A1.

In a further possible advantageous use of shuttling of the water by means of the pump 24, it may be provided that this water is heated by means of the heating device 25 to a higher temperature than necessary for a washing process, for example to over 80° C. or even 90° C. Then the pump 24 could in effect be cleaned or clean itself with hot water, in particular when the water returns with reversed flow direction from pumping operation, wherein some regions in the pump 24 or in a pump chamber, pressure connector and/or suction connector can be reached better. This water need also not be used for a washing process and may then, since it probably contains contaminants from the cleaning process, be pumped out of the washing machine 11.

Figure 5:
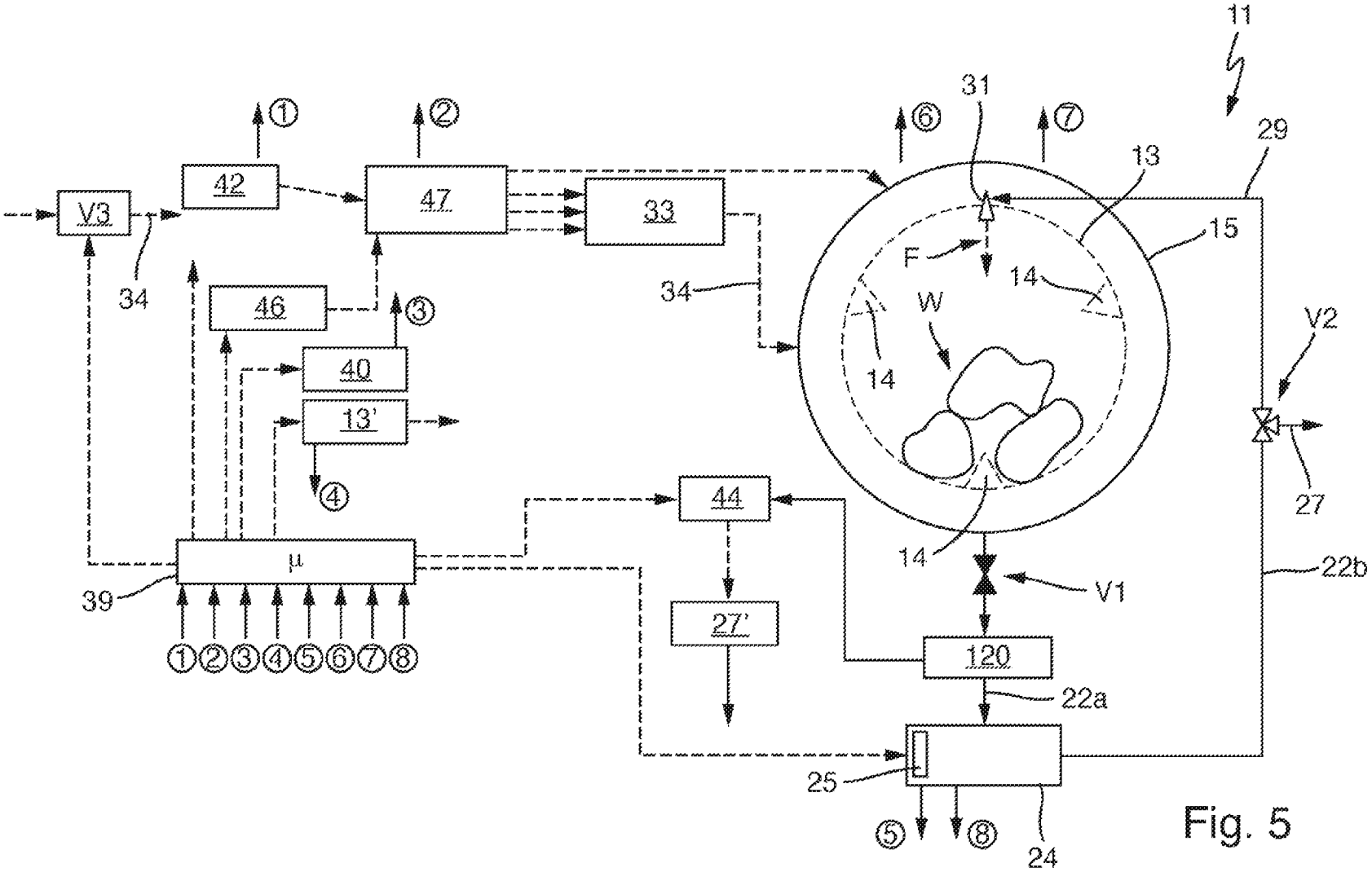

FIG. 5 shows again in detail the functional process of a washing method and the possibilities which result from the invention. A washing machine controller 39 is depicted which is connected to the functional units already described via signal lines indicated with dashes. The washing machine controller 39 is thus connected to the pump 24 or the heating device 25, and to a lye pump 44 which may be provided, connected firstly to the water reservoir 120 and secondly arranged upstream of a water outlet 27' for pumping out water. Furthermore, it is connected to a valve V3 and a flow sensor 42 which is advantageously provided in the water pipe 22*a*, 22*b* and/or 34. It is also connected to an actuator 46 which acts on a water switch unit 47, which advantageously can supply fresh water in various ways to a washing agent container 33. These various supply possibilities are indicated by the three horizontal dotted arrows between the water switch unit 47 and the washing agent container 33. The washing machine controller 39 is then connected signal-transmissively to a door lock 40 and a drum drive motor 13'. Thus the washing machine controller 39 receives information about a conveyed water volume (1) from the flow sensor 42, and information about a position (2) of the water switch unit 47. The door lock 40 provides information (3) about the locking state or closing state of a door to the drum 13. Information (8) about the operating state of the pump is provided by the pump 24 or its pump motor with respect to a pumping operation of the pump 24, advantageously with respect to a pumping power or similar, in some cases similarly by the lye pump 44 which may be provided. The heating device 25 provides information (5) about the operating state of the heating device 25 or the heating mode, in some cases also about the temperature of the water, irrespective of pumping operation. This may also come from the temperature sensor 26 in FIG. 1. The drum-receiving container 15 may provide information in particular with respect to the supply pipe 29, and the drum drive motor 13' may provide information (7) about the movement and/or rotational position of the drum 13, in some cases also with respect to the loading or type of laundry, see EP 3608466 A1. This information (7) may alternatively come from a corresponding sensor.

This information (1) to (7) is processed by the washing machine controller 39 according to the prescribed washing method. By means of the signals, for example from the door lock 40, it is ensured in the known fashion that the door cannot be opened during the washing process. The other information is used directly for performance of the washing method, in particular with respect to the addition of washing agent or additives and temperature.

The invention claimed is:

1. A method for operating a washing machine with: a rotatable drum for receiving laundry, a drum-receiving container around said drum, which comprises an outlet from said drum-receiving container, a pump for pumping liquid, wherein said pump comprises an integrated heating device and a pump outlet, an injector on said drum-receiving container for introducing water into said drum onto laundry arranged therein, wherein said injector is arranged higher in a vertical direction than said pump, a water circuit comprising several water pipes, wherein at least one said water pipe runs from said outlet from said drum-receiving container to said pump, and at least one said water pipe runs from said pump to said injector, a water reservoir between said outlet and said pump, wherein said water reservoir is connected to at least one said water pipe from said outlet from said drum-receiving container to said pump, or is arranged in at least one said water pipe, wherein: an outlet valve is provided in at least one said water pipe from said outlet from said drum-receiving container to said pump, the pump further comprises a pump outlet connected to a pump valve via at least one said water pipe, and said pump valve has an output to a water outlet from said washing machine, said method having the following steps:

pumping a water volume in said water, by said pump, from said water reservoir into said water pipe between said pump and said injector up to a predefined limit water volume, wherein, during said pumping step, the water is being heated, thereafter returning said previously pumped water volume into said water reservoir without a pumping operation of said pump, repeating of the steps of pumping and heating and returning for a specific time period, a specific number of repetitions, or until a desired predefined temperature for said water is reached to constitute heated water, and subsequent pumping of said heated water, via said water pipe to said injector, and injection of said heated water through said injector into said drum onto laundry placed therein.

2. The method as claimed in claim 1, wherein during multiple performances of said pumping of water volume step and/or during introduction of said heated water into said drum, no water is introduced into said water reservoir from outside the washing machine.

3. The method as claimed in claim 1, wherein a temperature detection of said water takes place at said pump and/or at said water circuit, wherein a temperature detection at said water circuit takes place downstream of said pump and upstream of said injector.

4. The method as claimed in claim 1, wherein said drum is not moved during repetition of said steps of pumping and heating and return of said water until after injection of said heated water via said injector into said drum onto laundry placed therein.

5. The method as claimed in claim 4, wherein said drum is rotated by maximum half a revolution or by at least two revolutions after injection of said heated water via said injector.

6. The method as claimed in claim 1, wherein said heated water is removed from said water reservoir by said pump concurrently with intake of further water into said water reservoir, wherein said heated water removal continues until a detected temperature is less than a limit temperature, in order to avoid said water below said limit temperature being injected into said drum.

7. The method as claimed in claim 6, wherein water remaining in said water circuit downstream of said pump is returned into said water reservoir by stopping said heated water removal by said pump, and then said water remaining is repeatedly pumped by said pump into said water circuit and heated.

8. The method as claimed in claim 7, wherein said water reservoir has a filter and said heated water returned into said water reservoir passes through said filter.

9. The method as claimed in claim 1, wherein said outlet valve is configured to allow air with positive pressure to enter or escape therethrough, but not water.

10. The method as claimed in claim 1, wherein washing agent and/or other additives for washing laundry are introduced into said water reservoir.

11. The method as claimed in claim 10, wherein washing agent and/or other additives for washing laundry are introduced into said water reservoir by means of a dosing device from a respective storage container inside said washing machine.

12. The method as claimed in claim 11, wherein water with washing agent and/or other additives dissolved therein is pumped repeatedly by said pump into at least one said water pipe to said pump valve and returned into said water reservoir for mixing or dissolving of said washing agent and/or other said additives with said water.

* * * * *